US005097607A

United States Patent [19]

Fredericksen

[11] Patent Number: 5,097,607

[45] Date of Patent: * Mar. 24, 1992

[54] FLUID FOREFOOT FOOTWARE

[75] Inventor: Raymond M. Fredericksen, Okemos, Mich.

[73] Assignee: Wolverine World Wide, Inc., Rockford, Mich.

[ * ] Notice: The portion of the term of this patent subsequent to Jun. 19, 2007 has been disclaimed.

[21] Appl. No.: 520,373

[22] Filed: May 7, 1990

[51] Int. Cl.[5] ..... A43B 13/18; A43B 19/00

[52] U.S. Cl. ..... 36/291; 36/28; 36/71; 36/153

[58] Field of Search ..... 36/28, 29, 43, 71

[56] References Cited

U.S. PATENT DOCUMENTS

| | | | |
|---|---|---|---|
| 3,795,994 | 3/1974 | Ava | 36/29 |
| 4,471,538 | 9/1984 | Pomeranz et al. | 36/28 |
| 4,472,890 | 9/1984 | Gilbert | 36/28 |
| 4,597,195 | 7/1986 | Dananberg | 36/43 X |
| 4,768,295 | 9/1988 | Ito | 36/28 |
| 4,777,739 | 10/1988 | Hiles | 36/43 |
| 4,779,359 | 10/1988 | Famolare, Jr. | 36/29 |
| 4,934,072 | 6/1990 | Fredericksen et al. | 36/28 X |

FOREIGN PATENT DOCUMENTS

| | | | |
|---|---|---|---|
| 2221378 | 2/1990 | United Kingdom | 36/29 |

*Primary Examiner*—Paul T. Sewell
*Assistant Examiner*—BethAnne C. Cicconi
*Attorney, Agent, or Firm*—Price, Heneveld, Cooper, DeWitt & Litton

[57] ABSTRACT

A shoe and shoe sole for accommodating forefoot strike activities such as aerobics, and forefoot strike tendencies of runners and the like, to forestall stress features, tendonitis and muscle tears, by incorporating a special forefoot pad in the midsole. The pad has a forward chamber and a rearward chamber, separated by an internal wall with restricted orifices therein, the forward chamber being larger and extending curvilinearly beneath the five metatarsal heads of the foot, and the rearward chamber being smaller and extending behind the second, third and fourth metatarsal heads in the arch region of the foot. Impact compression by the metatarsal heads on the forward chamber causes controlled viscous liquid flow into the rearward chamber to absorb impact force, and such that the amount of liquid in the rearward chamber is temporarily greater than its at rest volume, causing the walls of that chamber to bulge and form a temporary arch support. Release of force on the forward chamber results in the resilient flexible bulging walls of the rearward chamber forcing liquid back to the forward chamber.

20 Claims, 2 Drawing Sheets

FLUID FOREFOOT FOOTWARE

BACKGROUND OF THE INVENTION

This invention relates to athletic footwear, and particularly to the forefoot portion of athletic footwear. Many athletic movements in activities such as aerobic dance and basketball involve foot impacts which are initiated or concentrated on the forefoot. Even runners whose feet are of a high arch rigid structure will make initial impact with the surface on the fore part region of the foot.

Vertical ground reaction forces associated with such forefoot activities are considerably higher than those recorded for normal walking. Magnitudes of 4 to 5 times body weight have been reported for movements in aerobic dance and in basketball rebounding. A midfoot striking runner will exhibit a vertical ground reaction force spike of 2 to 3 times body weight, but because of the forefoot kinematics involved cannot easily attenuate shock through pronation.

Many overuse injuries such as stress fractures, tendonitis and muscle tears have been attributed to these high level magnitudes and velocities of ground reaction force loading.

The structure of copending application Ser. No. 339,198, filed Apr. 14, 1989, was developed for heel strike activities, but is not effective for forefoot and midfoot strike action.

SUMMARY OF THE INVENTION

An object of the invention is to provide an athletic shoe construction particularly advantageous for forefoot and midfoot strike activities such as aerobic exercise and the like, or for persons with the tendency of forefoot or midfoot strike during running and related activities. The novel shoe also provides forefoot compliance for basically all users.

The novel structure uniquely accommodates difficulties associated with forefoot landing kinematics. The forefoot pad of this invention is designed to ensure that all five metatarsal heads contact the same forepart chamber. Fluid is forced rearwardly by the downward force applied via the metatarsal heads, into a smaller rear chamber positioned behind metatarsal heads two through four. This design serves at least two functions in addressing forefoot kinematics. First, it functions as an adaptable, hydraulic shock absorber. Second, as fluid is forced into the smaller rear chamber, the encapsulating walls bulge, thereby creating a transverse metatarsal arch support. Since this chamber is positioned behind metatarsal heads two, three and four, the first and fifth metatarsals ensure stabilization of the foot.

The novel construction is useful even for running shoes wherein the runner experiences heel strike prior to forefoot strike. The novel forefoot construction provides arch support and also resiliency with stability beneath the metatarsal heads during the latter portions of the gait cycle.

DESCRIPTION OF THE PREFERRED EMBODIMENTS

Figure 1:
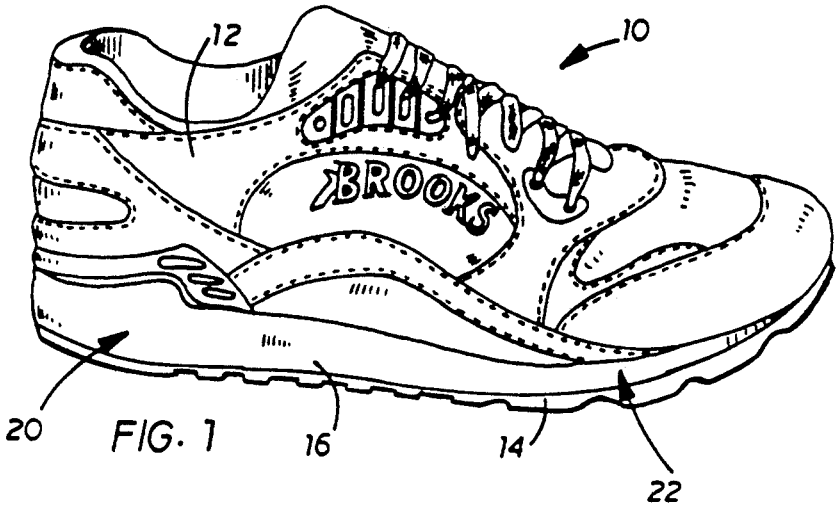
FIG. 1 is a perspective view of an athletic shoe incorporating this invention.
Figure 2:
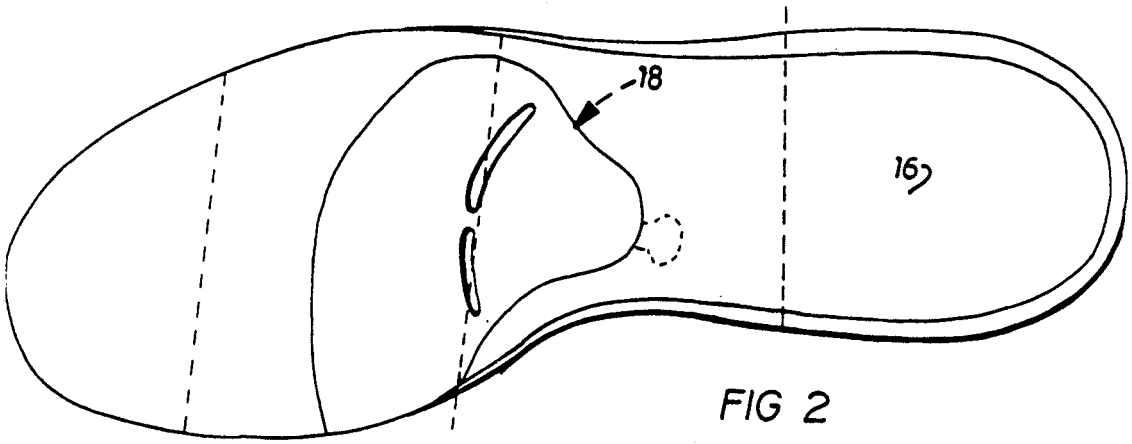
FIG. 2 is a plan view of the sole of the shoe in FIG. 1, showing the placement location of the novel hydrodynamic forefoot pad in the midsole.
Figure 3:
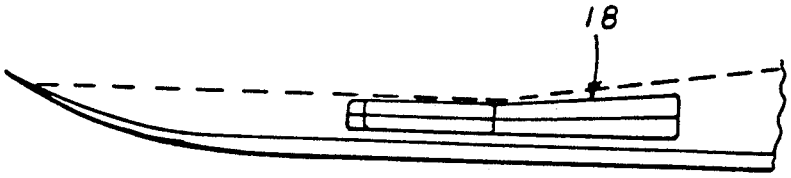
FIG. 3 is a side elevational view of the pad relative to the outsole shown in solid lines and the midsole plus heel wedge shown in dashed lines.

Referring now specifically to the drawings, the shoe 10 depicted is an athletic shoe as for aerobics or the like. The shoe has a selected typical upper 12, an outsole 14, and a midsole 16 incorporating the novel hydrodynamic forefoot pad 18. Optionally, an insole (not shown) is positioned within the shoe above the midsole. The shoe may also include a typical sock liner. The shoe sole assembly includes a heel portion 20 and a forefoot portion 22.

Figure 6:
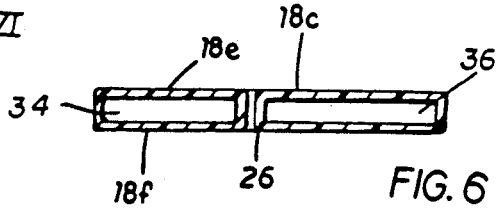
FIG. 6 is a sectional view taken on plane VI—VI of FIG. 4.

The forefoot pad 18 comprises an integral, hollow, polymeric body containing a forward chamber **18*a* and a smaller rearward chamber 18*b*. These chambers are separated by an interior double wall preferably formed in two parts 18*c* and 18*c*'. These two parts are preferably curvilinear and aligned with each other, but linearly spaced from each other such that there are formed restricted orifices 24*a*, 24*b* and 24*c*. Orifice 24*a* is between interior wall 18*c* and the adjacent lateral side of the body, orifice 24*b* is between the ends of the two wall portions, and orifice 24*c* is between walls 18*c*' and the medial wall of the body. This body is formed with a top wall 18*e*, a bottom wall 18*f* and a peripheral wall 18*g* integrally joining the top and bottom walls. The interior walls 18*c* and 18*c*' are preferably formed by interconnecting the top and bottom walls in these areas, as shown most clearly in FIG. 6. Thus, each wall portion 18*c* and 18*c*' is a double wall having an exterior air space 26 therebetween. The unit may be injection molded, having an integral, hollow sprue 30 forming a passage preferably at the rear thereof. Through this hollow passage the interior of the pad is filled with a viscous liquid, preferably a silicone having a viscosity of approximately 1000 centistokes. After filling, the sprue is sealed off as by pressure and heat to form the closed tab 32. There is restricted fluid flow communication between chambers 34 and 36 as a result of orifices 24*a*, 24*b* and 24*c*. Forward chamber 34 extends substantially from the lateral to the medial edges of the shoe sole, to underlie all five metatarsal heads of the foot. The forward chamber has a generally curved configuration. Rearward chamber 36** is behind the line of metatarsal heads and specifically extends behind the second, third and fourth metatarsal heads, beneath the arch of the foot. In practical construction of the shoe, the forefoot pad can extend basically to the medial edge of the shoe sole, but terminates about 5 millimeters short of the lateral edge to allow space for lasting. The pad is preferably visible through a window on the inside or medial side of the shoe in its chamber in the midsole.

The volume of front chamber 34 is considerably greater than the volume of rear chamber 36. The volume of viscous liquid in the body is greater than the volume of the forward chamber at rest and greater than the volume of the rearward chamber at rest, but less than the volume of the two chambers combined. Preferably, the viscous liquid fills about 80%-90% of the total combined volumes of the two chambers, with a gas, normally air, filling the remaining 10%-20% of the combined volume.

Preferably the pad walls are formed of polyurethane polymer, although alternatively other polymers such as ethylene vinyl acetate, polyvinylchloride, or the like could be used. The polymer has resilient flexibility such that it can be resiliently distorted from its at rest condition, but has "memory" to return it to the at rest condition. The overall thickness of the rear portion of the pad is greater than the forward portion, the pad tapering from the greatest thickness at the rear edge to the middle region of the pad and having the least thickness from the middle region to the forward edge.

The wall thickness of the integral pad is preferably approximately 1-2 mm. The rear edge preferably has a thickness of approximately 10 mm, tapering down to the middle where the edge of the heel wedge of the shoe is typically located. The forward portion of the pad preferably has a thickness from the middle to the front edge of the pad of about 7 mm. The orifices 24*a*, 24*b* and 24*c* preferably are each approximately 5 mm. in width and approach 5 mm. in height when using a liquid of the above noted viscosity. If a liquid of less viscosity is employed, the orifices should be smaller. If a liquid of greater viscosity is employed, the orifices should be larger.

Figure 5:
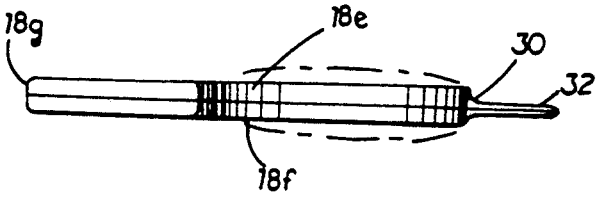
FIG. 5 is a side elevational view taken from the direction V—V of FIG. 4.

The novel construction not only accommodates the forefoot kinematics wherein all five metatarsal heads typically strike simultaneously, or almost simultaneously, attenuating the usual shock as a shock absorber, but also creates a temporary transverse metatarsal arch support beneath the arch of the foot. This latter effect occurs as the liquid is forced rearwardly under the pressure of the metatarsal heads into the smaller rear chamber, causing the encapsulating walls to bulge as illustrated by the phantom lines in FIG. 5. The pad provides forefoot compliance. As noted, the pad does not extend beneath the portion of the foot behind the first and fifth metatarsal heads. This tends to assure stability of the foot. It will be noted that all five metatarsal heads engage the same forward chamber. When the fluid is forced into the rear chamber by force applied to the forward chamber, the amount of fluid in the rear chamber is temporarily greater than the at-rest volume of this chamber.

The liquid forced into the small rear chamber to bulge the walls and form the arch support is subsequently forced back into the forward chamber by the resiliency of the bulging walls as pressure is removed from the metatarsal heads and the forward chamber.

Figure 7:
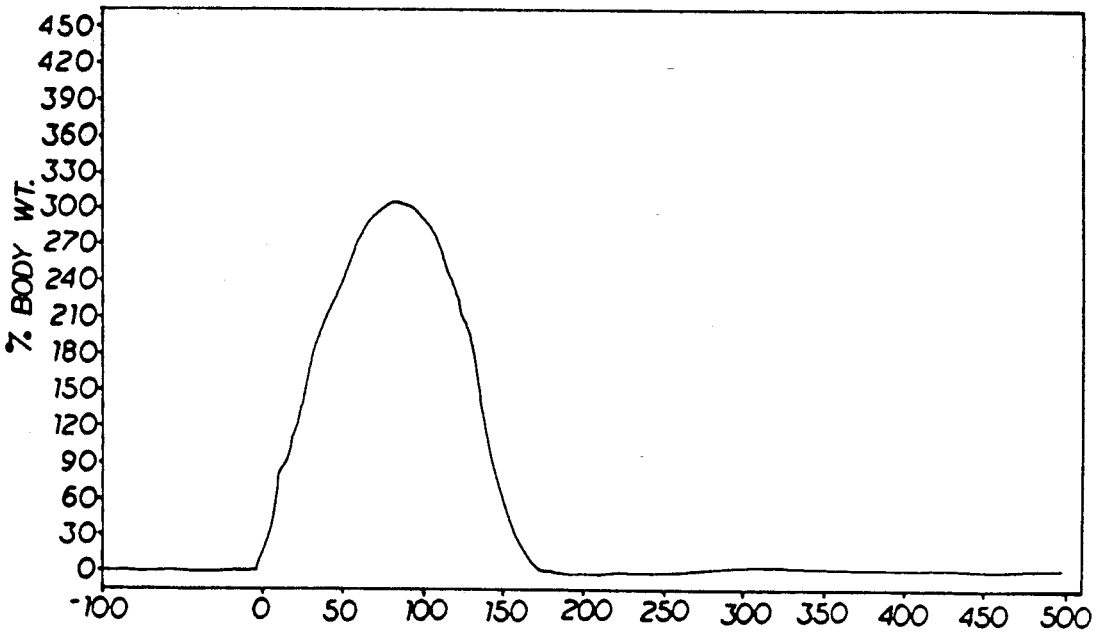
FIG. 7 is a diagram of a forefoot impact load force pattern, over a time interval, employing the present invention.
Figure 4:
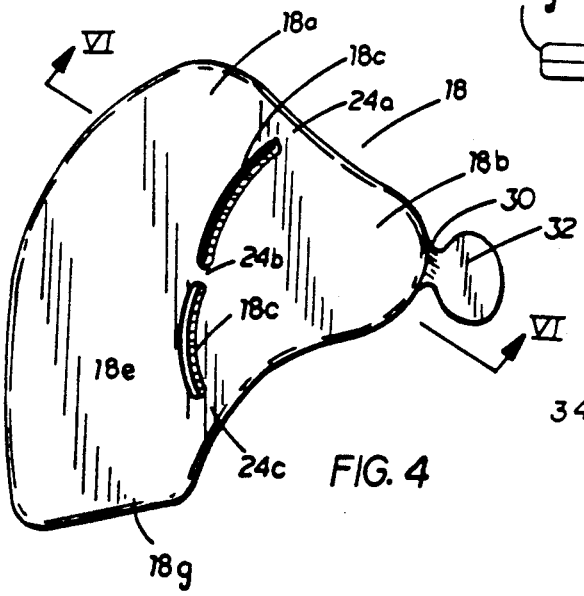
FIG. 4 is a plan view of the pad itself.

One result of the novel structure is the smooth dissipation of the usual sharp, initial impact on the forefoot over a longer period of time. This dissipation is illustrated by the smooth curve depicted in the example force plot of FIG. 7. A sharp initial impact which is not so dissipated would appear as a high spike at the start of the curve. In the graph, the horizontal axis represents the time in milliseconds. The vertical axis represents the percent of body weight.

It is conceivable that the particular preferred embodiment described and shown herein to illustrate the inventive concept may be modified for particular style shoes or activities, while not departing from the invention. Hence, the invention is not intended to be limited by the specific illustrative embodiment set forth, but only by the scope of the appended claims and the reasonable equivalents thereto.

The embodiments of the invention in which an exclusive property or privilege is claimed are defined as follows.

1. A forefoot hydrodynamic pad for a shoe comprising:

an integral, hollow, polymeric body comprising a top flexible wall, a bottom flexible wall and a peripheral wall joining said top and bottom walls;

said body having a forward chamber and a rearward chamber;

said chambers being separated by an interior wall having restricted orifice means therein for restricted flow of fluid between said chambers;

said forward chamber being substantially larger than said rearward chamber and having a width sufficient to substantially underlie the five metatarsal heads of a foot;

said rearward chamber being narrower to extend behind the second through fourth metatarsal heads of the foot; and a fluid in said forward and rearward chambers, movable through said restricted orifice means from said forward chamber to said rearward chamber when said forward chamber is under compression beneath the metatarsal heads.

2. The forefoot hydrodynamic pad in claim 1 wherein said rearward chamber has a volume less than one-half that of said forward chamber.

3. The forefoot hydrodynamic pad in claim 1 wherein said forward chamber is curved in an arc beneath the metatarsals.

4. The forefoot hydrodynamic pad for a shoe in claim wherein compression on the fluid in said forward chamber causes said rearward chamber to become pressurized and said top and bottom walls of said rearward chamber to temporarily bulge such that said rearward chamber serves as a temporary transverse arch support for the foot.

5. The forefoot hydrodynamic pad in claim 1 wherein said top and bottom walls slope to the rear relative to each other, forming a thicker pad portion at said rearward chamber and a thinner pad portion at said forward chamber.

6. The forefoot hydrodynamic pad in claim 1 wherein said interior wall comprises pairs of walls formed by said top and bottom walls being joined in selected areas.

7. The forefoot hydrodynamic pad in claim 4 wherein said forward chamber has a greater volume than said rearward chamber.

8. The forefoot hydrodynamic pad in claim 7 wherein said fluid is a viscous liquid greater in volume than said forward chamber and greater in volume than said rearward chamber, but less in volume than said chambers combined.

9. The forefoot hydrodynamic pad in claim 1 wherein said fluid is a viscous liquid filling about 80%-90% of the volume of said chambers, and said top and bottom walls are of resilient polymer with sufficient flexibility to enable said walls to bulge temporarily under internal pressure in said rearward chamber when said forward chamber is put under compression via the metatarsal heads, such that said rearward chamber temporarily forms a transverse arch support.

10. A shoe construction comprising a sole assembly including a midsole and an upper;

said sole assembly including a forefoot pad in said midsole;

said forefoot pad comprising a flexible polymeric jacket defining a hollow space therein forming a larger forward chamber and a smaller rearward chamber;

an orificed wall between said chambers;

said chambers containing primarily a viscous liquid but also containing gas;

said liquid being partially movable in response to pressure on one of said chambers through said orificed wall into the other chamber;

said forward chamber being beneath the metatarsal head portion of a foot in said shoe and said rearward chamber being rearward of said metatarsal head portion and beneath the arch of a foot in said shoe such that pressure by metatarsal heads on said forward chamber will cause liquid flow into said rearward chamber to cause said rearward chamber to temporarily bulge and thereby provide arch support to the foot.

11. The shoe construction in claim 10 wherein said forward chamber has a width sufficient to extend beneath the five metatarsal heads of the foot, and said rearward chamber is of a width to extend behind the second, third and fourth metatarsal heads of the foot.

12. The shoe construction in claim 10 wherein said rearward chamber is deeper than said forward chamber.

13. The shoe construction in claim 10 wherein said forward chamber has a curved front wall that recedes rearwardly from the medial to the lateral sides of said shoe, and has a curved rear wall forming said orificed wall.

14. The shoe construction in claim 10 wherein said chambers have generally flat upper and lower walls which are resiliently flexible under internal pressure to temporarily bulge outwardly.

15. The shoe construction in claim 11 wherein said forward chamber has a greater volume than said rearward chamber.

16. The shoe construction in claim 11 wherein said viscous liquid comprises a volume of about 80%-90% of the combined volume of said chambers, and said gas comprises a volume of about 20%-10% of said combined volume.

17. The shoe construction in claim 16 wherein said orificed wall has a plurality of restricted flow orifices.

18. The shoe in claim 17 wherein said viscous liquid has a viscosity of about 1000 centistokes.

19. The shoe in claim 18 wherein said liquid is a silicone.

20. The shoe in claim 11 wherein said rearward chamber has a slight taper increasing in width toward the rear of said rearward chamber.

* * * * *

UNITED STATES PATENT AND TRADEMARK OFFICE

CERTIFICATE OF CORRECTION

PATENT NO. : 5,097,607

DATED : March 24, 1992

INVENTOR(S) : Raymond M. Fredericksen

It is certified that error appears in the above-identified patent and that said Letters Patent is hereby corrected as shown below:

Column 4, claim 4, lines 35 and 36;
"claim wherein" should be -- claim 1 wherein.

Signed and Sealed this

Twelfth Day of October, 1993

Bruce Lehman

*Attest:*

BRUCE LEHMAN

*Attesting Officer*

*Commissioner of Patents and Trademarks*